US007019669B1

(12) United States Patent
Carr

(10) Patent No.: US 7,019,669 B1
(45) Date of Patent: Mar. 28, 2006

(54) TRAIL SAFE ALERT SYSTEM

(76) Inventor: Robert Carey Carr, 40 High Meadow La., Wakefield, RI (US) 02879

( * ) Notice: Subject to any disclaimer, the term of this patent is extended or adjusted under 35 U.S.C. 154(b) by 99 days.

(21) Appl. No.: 10/724,813

(22) Filed: Dec. 1, 2003

(51) Int. Cl.
*G08G 1/07* (2006.01)

(52) U.S. Cl. ..... 340/906; 340/917; 340/944

(58) Field of Classification Search ..... 340/917, 340/906, 902, 693.3, 539.1, 944, 925, 907
See application file for complete search history.

(56) References Cited

U.S. PATENT DOCUMENTS

| | | | | |
|---|---|---|---|---|
| 4,162,477 | A * | 7/1979 | Munkberg | 340/906 |
| 4,590,474 | A * | 5/1986 | Patterson et al. | 340/944 |
| 4,775,865 | A * | 10/1988 | Smith et al. | 340/906 |
| 5,014,052 | A * | 5/1991 | Obeck | 340/906 |
| 5,331,325 | A * | 7/1994 | Miller | 341/176 |
| 5,652,569 | A * | 7/1997 | Gerstenberger et al. | 340/573.4 |
| 6,072,406 | A * | 6/2000 | Leonard et al. | 340/902 |
| RE36,930 | E * | 10/2000 | Houten et al. | 340/944 |
| 6,384,742 | B1 * | 5/2002 | Harrison | 340/944 |
| 2001/0054970 | A1 * | 12/2001 | Jones | 340/915 |
| 2002/0126022 | A1 * | 9/2002 | Ellis | 340/901 |

* cited by examiner

*Primary Examiner*—Jeffery Hofsass
*Assistant Examiner*—Hoi C. Lau
(74) *Attorney, Agent, or Firm*—Michael I. Kroll

(57) ABSTRACT

A pedestrian trail signaling device for warning users of the trail or path when an emergency vehicle is approaching the intersection. Emergency vehicles 14 have an actuatable transceiver that transmits a signal to the trail posted signaling device causing warning lights to flash and generation of a response signal informing the emergency vehicle operator that the trail posted signaling device has received the emergency vehicle transmission. A user transmitter having an on/off switch that broadcasts a signal to the trail signaling device causing the signaling device blinking yellow LED displays to blink A passive detector is provided whereby an emergency vehicle strobe light can trigger both flashing warning signals when the passive detector(s) is triggered. A motion detector 44 located on the trail user 16 warning light whereby either or both systems will flash their respective predetermined warning signals when the motion detector(s) is triggered.

2 Claims, 10 Drawing Sheets

TRAIL SAFE ALERT SYSTEM

BACKGROUND OF THE INVENTION

1. Field of the Invention

The present invention relates generally to signaling devices and, more specifically, to a trail signaling device positioned at a location where a pedestrian or recreational trail path crosses a motorized access road whereby users of the trail or path receive a warning when an emergency vehicle, such as ambulance, police, fire equipment, rescue vehicle, etc. is approaching the intersection of the trail or path in an emergency situation. The emergency vehicles have an actuatable transceiver that when actuated transmits a signal at a predetermined frequency that when received by the trail posted signaling device transceiver causes the signaling device warning lights to flash for a predetermined period of time, in addition to generating a response signal informing the emergency vehicle operator, via an LED display, that the trial posted signaling device has received the emergency vehicle transmission.

Furthermore, the present invention provides an wherein trail user's can carry a transmitter having an on/off switch or button when pushed will broadcast on a predetermined frequency that when received by the trail signaling device causes the signaling device blinking yellow LED displays positioned within line of sight of the user's of the motor vehicle access road to blink for a predetermined period of time.

In addition, the present invention provides for another additional element in the form of a passive detector located near the motor vehicle warning light whereby an emergency vehicle strobe light can trigger both flashing warning signals when the passive detector(s) is triggered.

Furthermore, the present invention provides for another additional element in the form of a motion detector located on the trail user warning light whereby either or both systems will flash their respective predetermined warning signals when the motion detector(s) is triggered.

2. Description of the Prior Art

While there are other signaling devices that have been used for crossings, it is felt that a need exists for providing a signaling device that will provide a warning for trails or bicycle paths whereby the user can warn approaching vehicles or said vehicles can be warned of the presence of pedestrians or bicycles, or other recreational trail path users.

SUMMARY OF THE PRESENT INVENTION

The present invention discloses a pedestrian trail signaling device positioned at a location where a pedestrian user or recreational trail path crosses a motorized access road whereby users of the trail or path receive a warning when an emergency vehicle, such as ambulance, police, fire equipment, rescue vehicle, etc., is approaching the intersection in an emergency situation. The emergency vehicles have an actuatable transceiver that when actuated transmits a signal at a predetermined frequency that when received by the trail posted signaling device transceiver causes the signaling device warning lights to flash for a predetermined period of time, in addition to generating a response signal informing the emergency vehicle operator, via an LED display, that the trail posted signaling device has received the emergency vehicle transmission. The present invention also provides a user transmitter having an on/off switch or button that when pushed will broadcast on a predetermined frequency, which frequency when received by the trail signaling device causes the signaling device blinking yellow LED displays positioned within line of sight of the users of the motor vehicle access road to blink for a predetermined period of time. The present invention also provides for a passive detector located near the motor vehicle warning light whereby an emergency vehicle strobe light can trigger both flashing warning signals when the passive detector(s) is triggered. The present invention also provides for motion detector located on the trail user warning light whereby either or both systems will flash their respective predetermined warning signals when the motion detector(s) is triggered.

A primary object of the present invention is to provide a signaling device for trail or bicycle path warning the users of approaching emergency vehicles.

Another object of the present invention is to provide a signaling device for trail or bicycle path warning motorists of the presence of path users.

Yet another object of the present invention is to provide a signaling device having means for engaging a flashing indicator when an emergency vehicle approaches.

Still yet another object of the present invention is to provide a signaling device that will automatically be disengaged after a predetermined period of time.

Another object of the present invention is to provide a signaling device having means for powering said signaling indicator.

Yet another object of the present invention is to provide a signaling indicator that will warn motorists of the presence of trail or bicycle path user's.

Still yet another object of the present invention is to provide trail or bicycle path users with a transmitter for engaging a signaling device at a road crossing indicating the presence of said path user.

Additional objects of the present invention will appear as the description proceeds.

The present invention overcomes the shortcomings of the prior art by providing a trail signaling device positioned at a location where a pedestrian or recreational trail path user crosses a motorized access road whereby users of the trail or path receive a warning when an emergency vehicle, such as ambulance, police, fire equipment, rescue vehicle, etc is approaching the intersection of the trail or path in an emergency situation. The emergency vehicles have an actuatable transceiver that when actuated transmits a signal at a predetermined frequency that when received by the trail posted signaling device transceiver causes the signaling device warning light to flash for a predetermined period of time, in addition to generating a response signal informing the emergency vehicle operator, via an LED display, that the trial posted signaling device has received the emergency vehicle transmission.

In addition, the present invention provides for another additional element in the form of a passive detector located near the motor vehicle warning light whereby an emergency vehicle strobe light can trigger both flashing warning signals when the passive detector(s) is triggered. Furthermore, the present invention provides for another additional element in the form of a motion detector located on the trail user warning light whereby either or both systems will flash their respective predetermined warning signals when the motion detector(s) is triggered.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
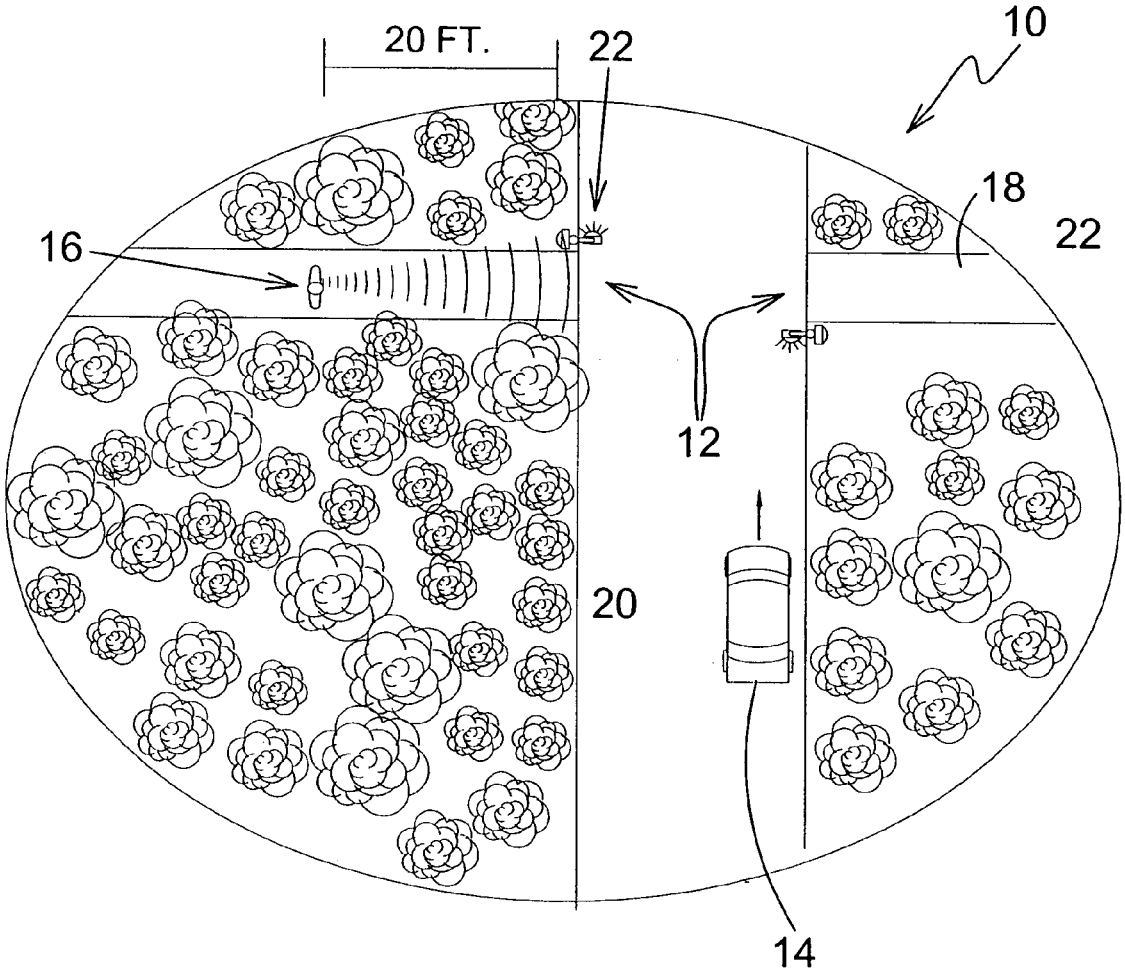
FIG. 1 is an illustrative view of the present invention in use.

With regard to reference numerals used, the following numbering is used throughout the drawings.

10 present invention
12 intersection
14 vehicle
16 trail user
18 red light
20 yellow light
22 trail crossing indicator
24 transceiver
26 solar panel
28 battery
30 trail/path
32 road
34 vehicle indicator
36 transceiver
38 dashboard
40 light display
42 passive detector
44 motion detector

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. Shown is the present invention 10 comprised of a trail signaling device positioned at the intersection 12 of trails and roads used by motor vehicles 14. The trail signaling device 22 is designed as a motorist 14 and trail user 16 safety device. For the trial user 16, a blinking red light 18 indicates the cross alert system has been activated by pushing a button on the key fob. In addition to emergency vehicle presence warning, the trail user 16 may have a transmitting device that will cause the yellow LED display 20 to actively blink indicating to motorists 14 the presence of a trail user. As an additional element, the fob will automatically broadcast a signal every 15 to 25 seconds to activate the system as they 14, 16 approach. The fob may also have an on/off switch with a red power on indicator.

Figure 2:
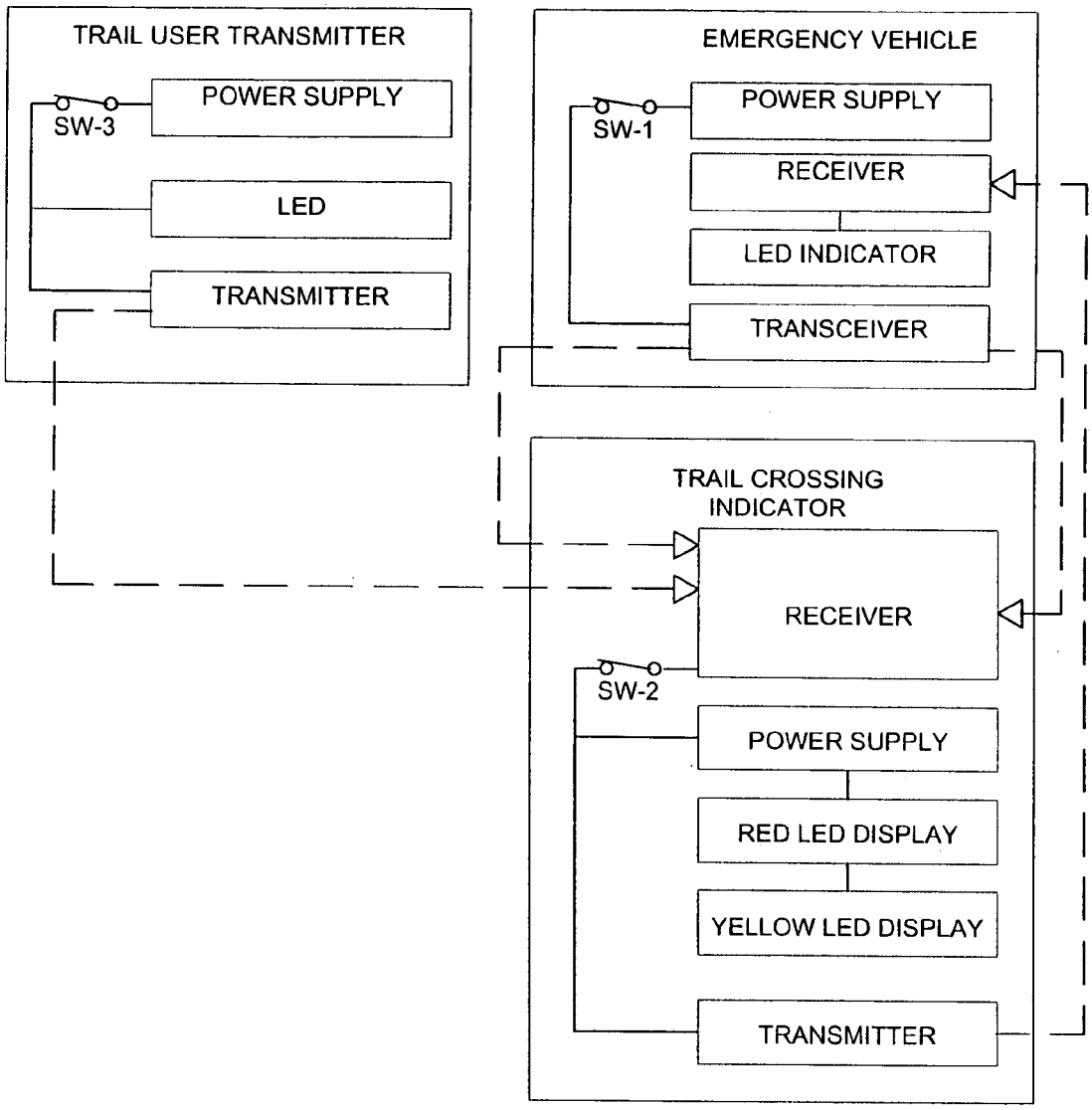
FIG. 2 is a block diagram of the present invention.

Turning to FIG. 2, shown therein is a block diagram of the present invention. When an on call emergency vehicle approaches the trail crossing warning indicator, switch sw-1 having been turned on activates the transceiver causing the transmitter to generate a signal that will be picked up by the receiver in the trail crossing signal indicator. The crossing receiver then turns on sw-2 to activate the red and yellow LED display to blink for a predetermined period of time, as well as, activate the crossing transmitter to generate a signal that will be received back by the emergency vehicle receiver that will energize the LED indicator signaling that the crossing device has been activated. When a trail user carries a proprietary transmitter and comes within a predetermined distance of the trail crossing signal indicator, switch sw-3 having been turned on activates the transmitter generating a signal that when received by the crossing signal indicator activates the blinking red and yellow LED display thereby warning a motorist of the presence of a trail user.

Figure 3:
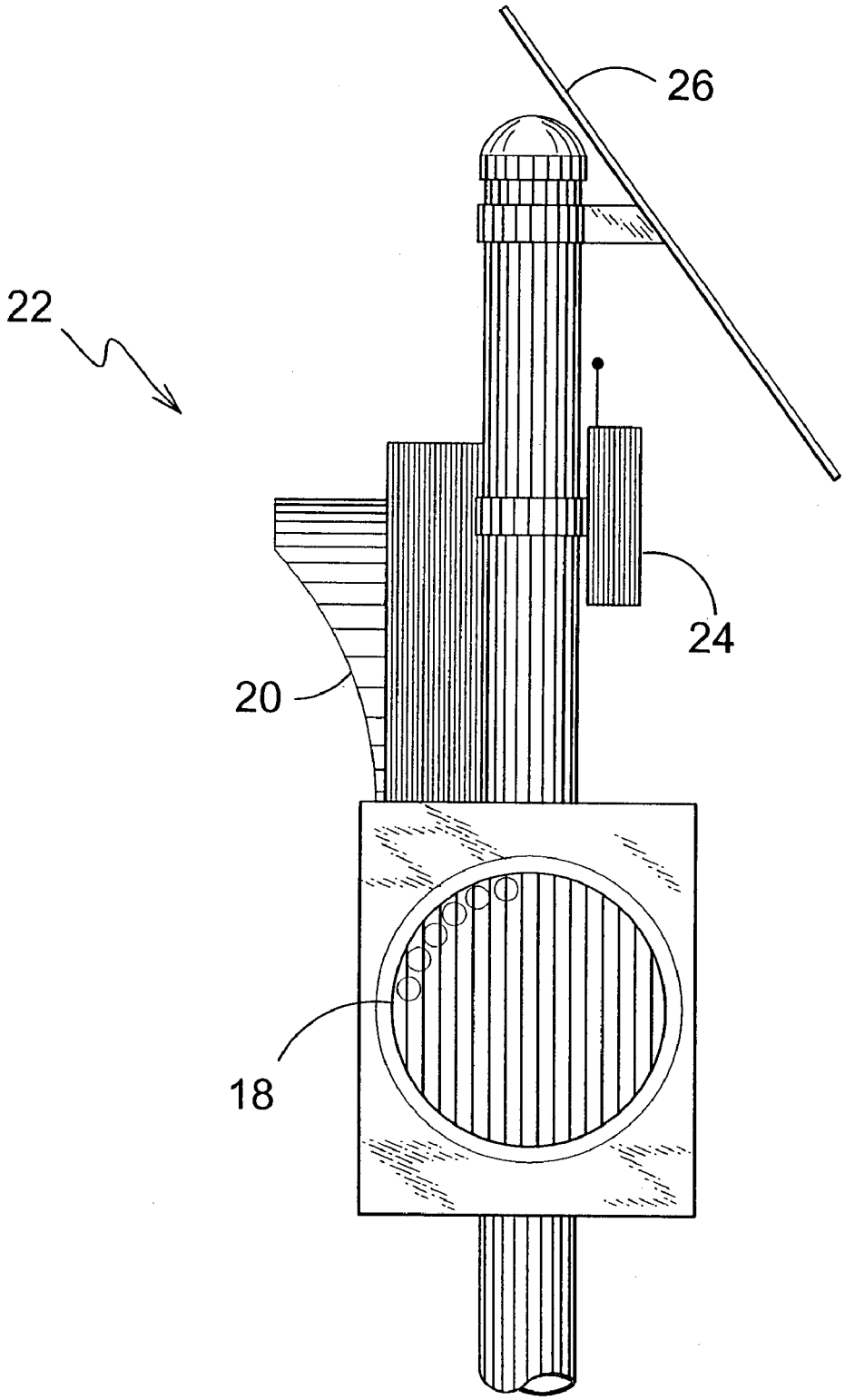
FIG. 3 is a side view of the trail posted crossing indicator.

Turning to FIG. 3, shown therein is a side view of the trail posted crossing indicator 22. Shown is the trail posted signaling device 22 having a red LED display 18 that will blink when triggered by the transmission of a predetermined frequency generated by emergency vehicles. The signaling device 22 has a transceiver/timer 24 for receiving the emergency vehicle transmission and a transmitter for replying to the emergency vehicle transmission with a predetermined response signal which will be received by the emergency vehicle's transceiver causing an interior vehicle indicator to acknowledge the signal. Also shown is means for powering the transceiver and LED display comprising a solar panel 26 charging batteries. Also shown is a yellow LED 20 facing the oncoming vehicular traffic.

Figure 4:
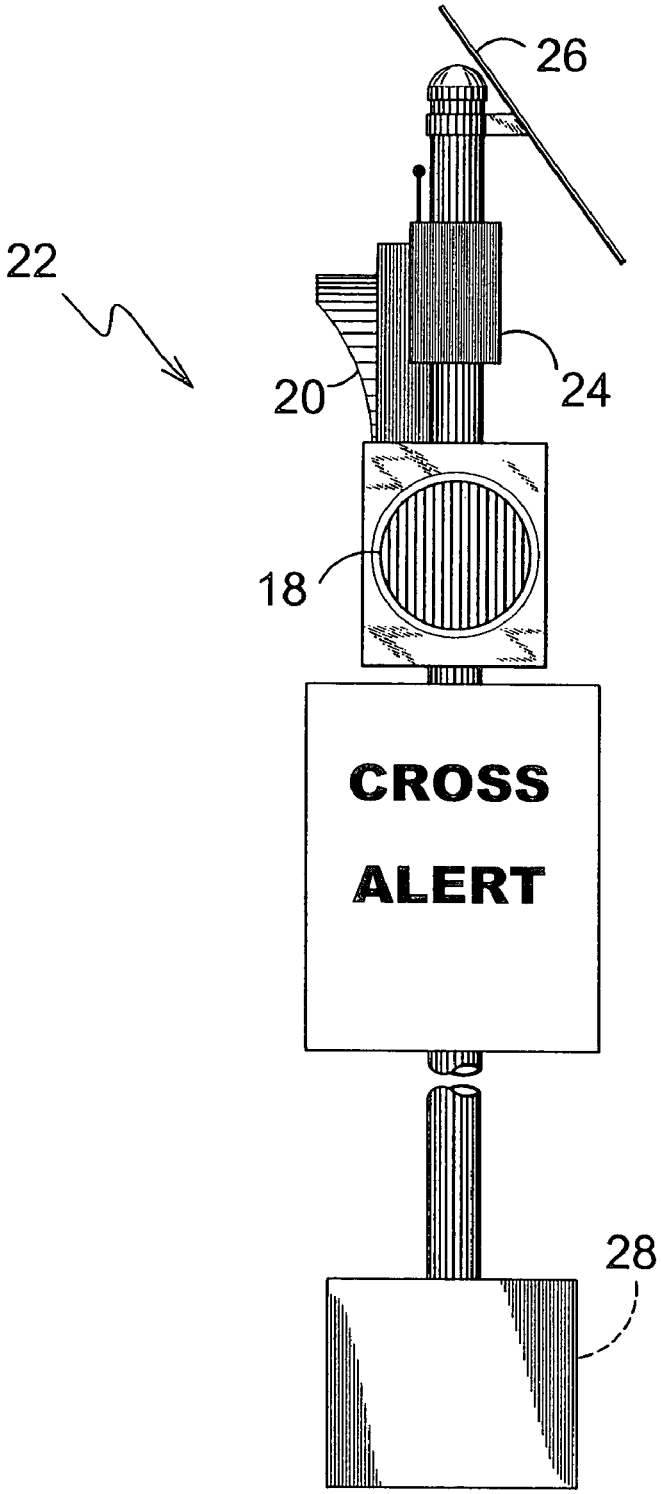
FIG. 4 is a side view of the trail posted crossing indicator with an alternate element.

Turning to FIG. 4, shown therein is a side view of the trail posted crossing indicator 22 with an alternate element. Shown is the trail posted signaling device 22 having an alternate location of the power supply wherein the batteries 28 are contained within a base structure. Also shown are the red 18 and yellow 20 LED displays that will blink when triggered by the transmission of a predetermined frequency generated by emergency vehicles. Along with the signaling device transceiver 24 that controls the energizing of the trail signal LED displays when an emergency vehicle transmission is received, the LED displays 18, 20 will be energized for a predetermined period of time and will respond with a signal generated for receipt by the emergency vehicle indicating that the trail crossing warning indicators have been triggered. A plurality of solar cells forms a solar panel 26 that is used to recharge the battery 28 or batteries.

Figure 5:
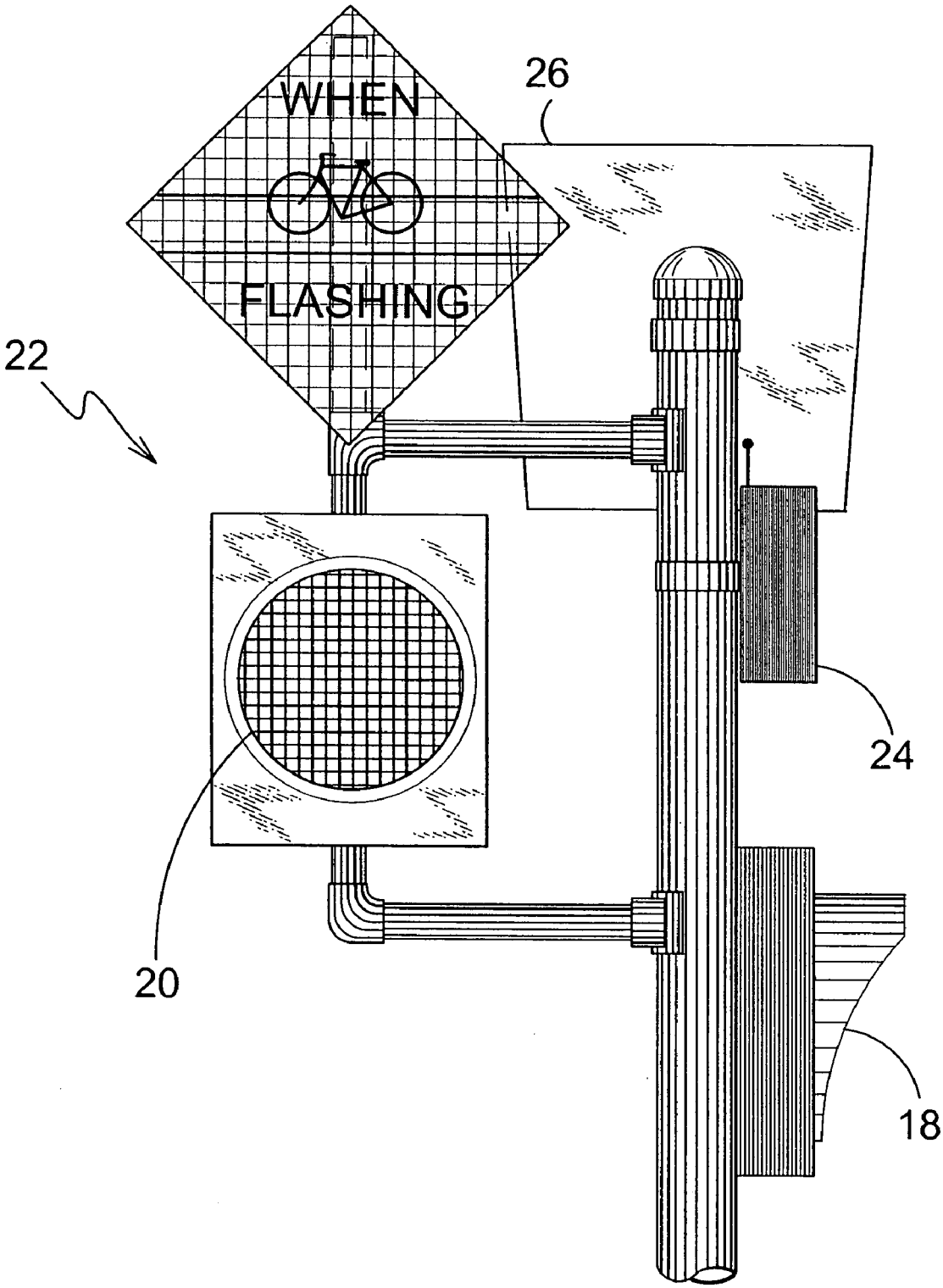
FIG. 5 is a front view of the trail posted crossing indicator.

Turning to FIG. 5, shown therein is a front view of the trail posted crossing indicator 22. Shown is the trail posted signaling device 22 having a red 18 LED display facing the trail that will blink when triggered by the transmission of a predetermined frequency generated by emergency vehicles. In addition, there is also a yellow 20 LED display facing the traffic that will be positioned in line of site of oncoming traffic. The signaling device 22 has a transceiver 24 for receiving the emergency vehicle transmission which will trigger the red 18 flashing LED display and a crossing indicator transmission for replying to the emergency vehicle transmission with a predetermined response signal which will be received by the emergency vehicle's transceiver causing an interior vehicle indicator to acknowledge the signal. The yellow 20 and red 18 LED display can be triggered by a key fob transmitting device worn by trail users warning motorists of an approaching trail user to the intersection. Also shown is the solar panel 26.

Figure 6:
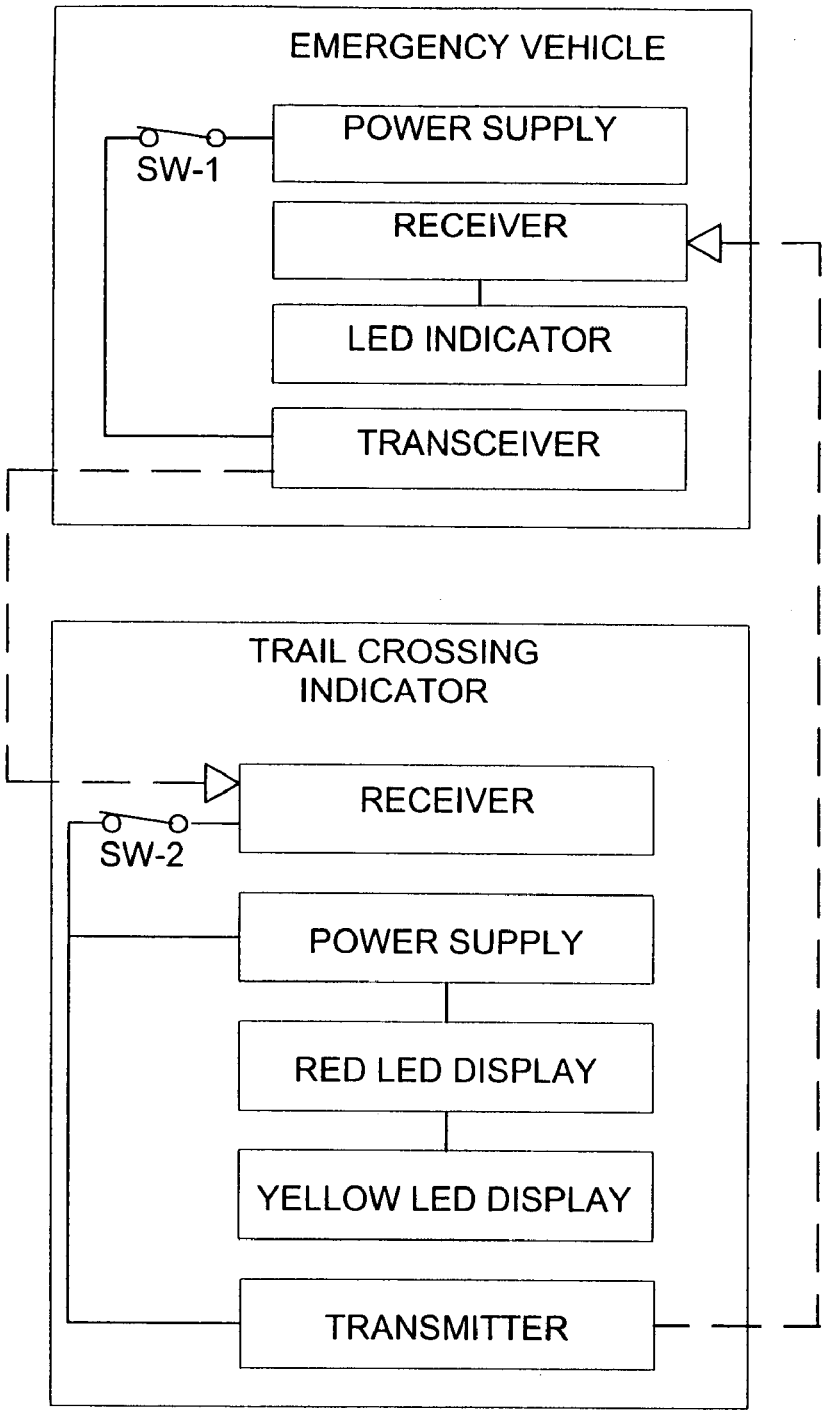
FIG. 6 is a block diagram of the present invention.

Turning to FIG. 6, shown therein is a block diagram of the present invention. The switch sw-1 has been turned on to activate the transceiver thereby enabling the transmitter to generate a signal that will be picked up by a receiver in the trail crossing signal indicator. This signal will override any trail users trying to use their personal safety device key fob. The crossing receiver turns on sw-2 to cause the red and yellow LED displays to blink for a predetermined period of time, as well as activate the crossing transmitter to generate a signal that will be received by the emergency vehicle receiver that will energize the LED indicator in the emergency vehicle thereby signaling that the crossing device has been activated.

Figure 7:
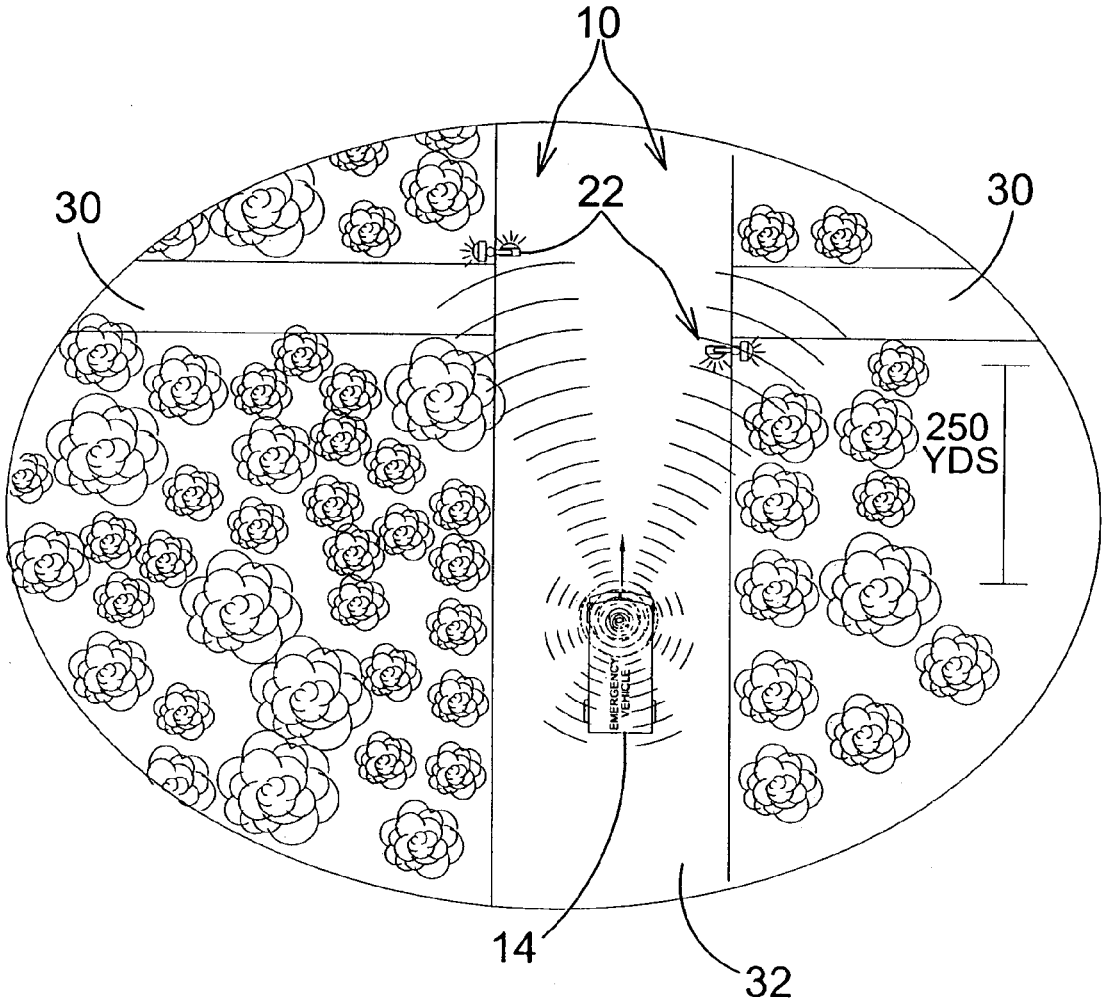
FIG. 7 is an illustrative view of the present invention in use.

Turning to FIG. 7, shown therein is an illustrative view of the present invention 10 in use. Shown is the present invention 10 comprised of a signaling device 22 positioned at a location where a pedestrian or recreational vehicle path or trail 30 crosses a motorized access road 32 whereby users of the trail or path receive a warning when an emergency vehicle 14, such as ambulance, police, fire equipment, rescue vehicle, etc., is approaching the intersection of the trail or path in an emergency situation. Emergency vehicles 14 have an activatable transceiver transmitting at a predetermined coded frequency that is received by a trail posted signaling device 22 causing the incorporated warning lights to flash for a predetermined period of time. The trail posted signaling device 22 has a transceiver that emits a response signal, in addition to activating the warning light, informing the emergency vehicle operator that the trial posted signaling device has received the emergency vehicle transmission.

Figure 8:
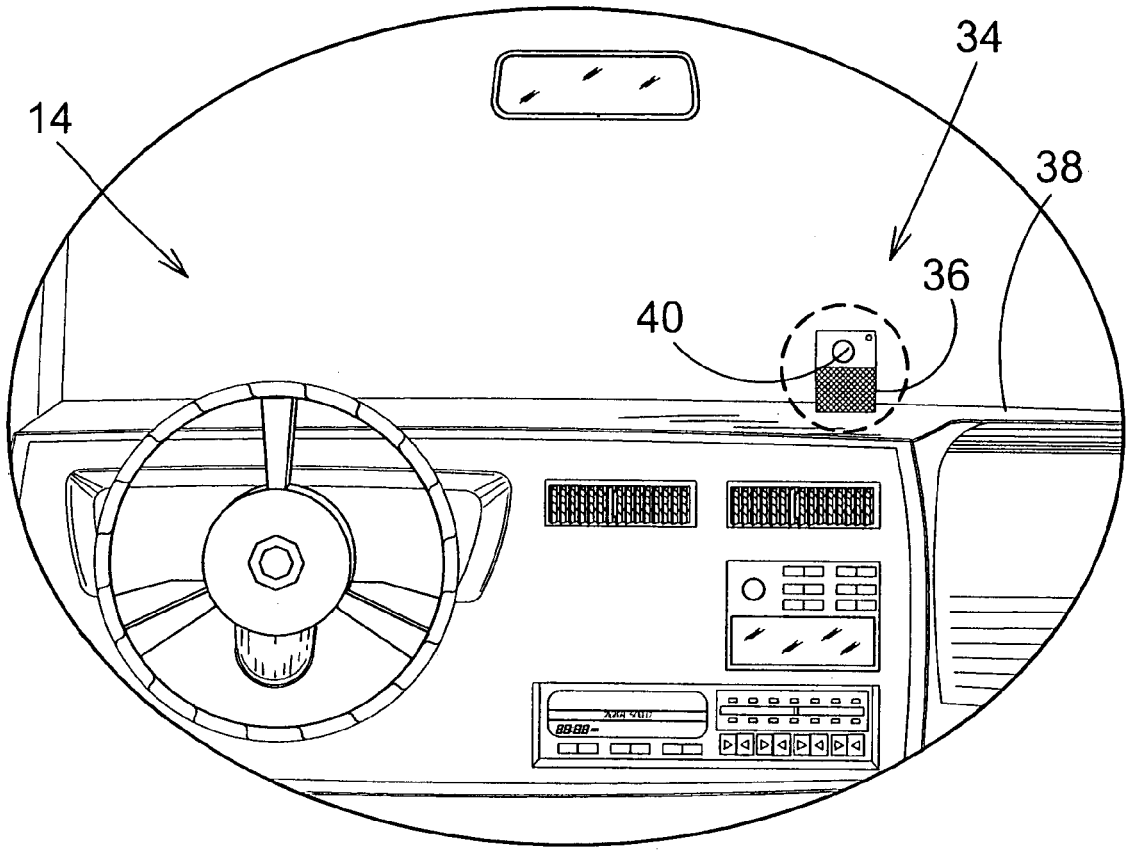
FIG. 8 is a perspective view of the emergency vehicle indicator.

Turning to FIG. 8, shown therein is a perspective view of the emergency vehicle indicator 34. Shown is the emergency vehicle indicator 34 comprising a visually and/or audibly perceptible indicator that informs the emergency vehicle operator that the trail signaling device has responded to the emergency vehicle transmission. The response indicator 34 is a visual indicator which can be mounted in any position viewable to the vehicle operator, e.g., on the dashboard 38 of vehicle 14. The transceiver 36 works off of the vehicle's 12v battery and has an on/off switch for engaging and disengaging the transceiver. In the preferred embodiment, the indicator 40 is a red or yellow LED display.

Figure 9:
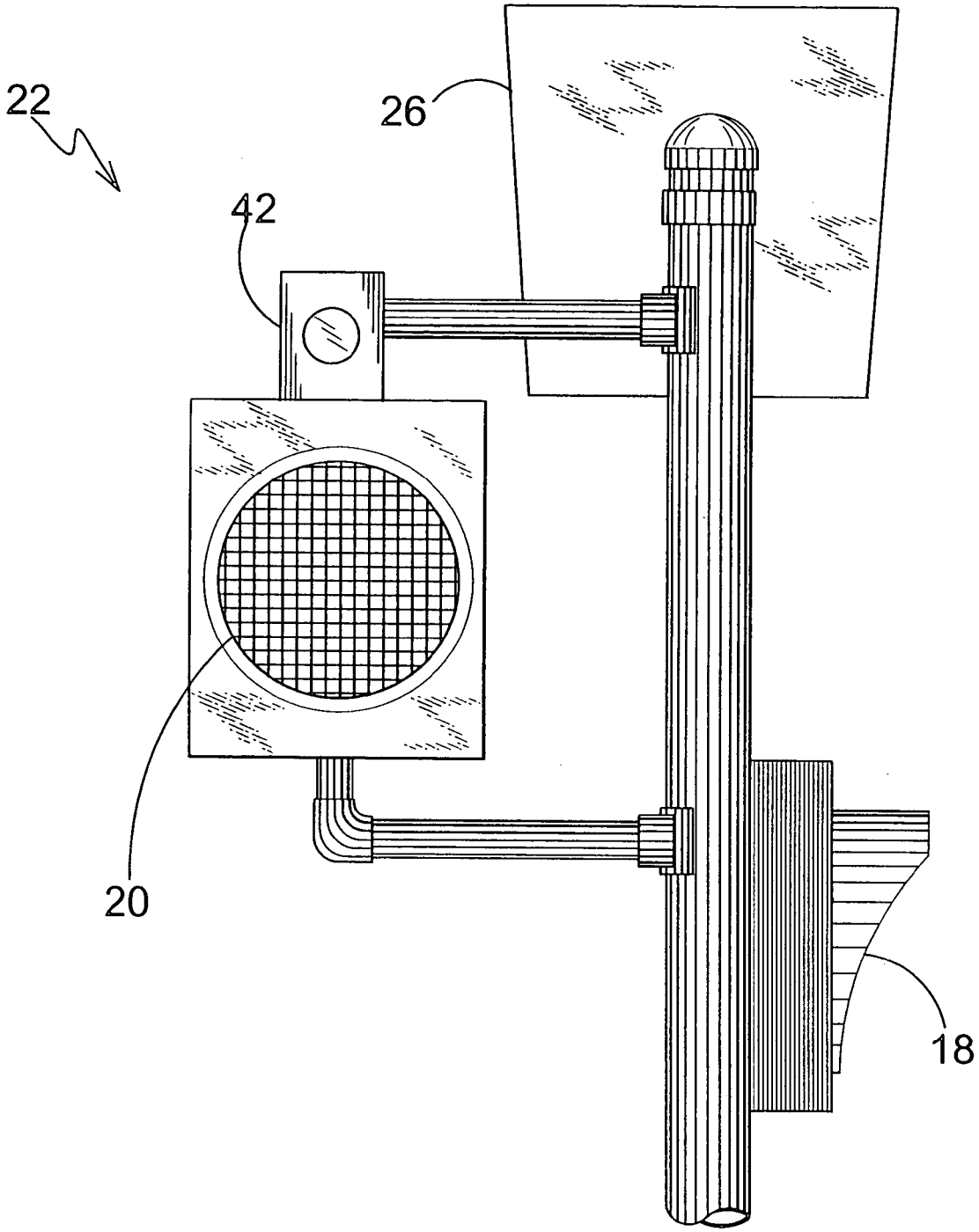
FIG. 9 is a front view of the trail posted crossing indicator having an additional element.

Turning to FIG. 9, shown therein is a front view of the trail posted crossing indicator 22 having an additional element. Shown is the trail posted signaling device 22 having an additional element in the form of a passive detector 42 that will activate the blinking red LED 18 display when an emergency vehicle equipped with the white strobe light passive detection system moves within a predefined area monitored by the detector thereby warning trail users of the presence of an approaching emergency vehicle. Also shown are the yellow light 20 and solar panel 26.

Figure 10:
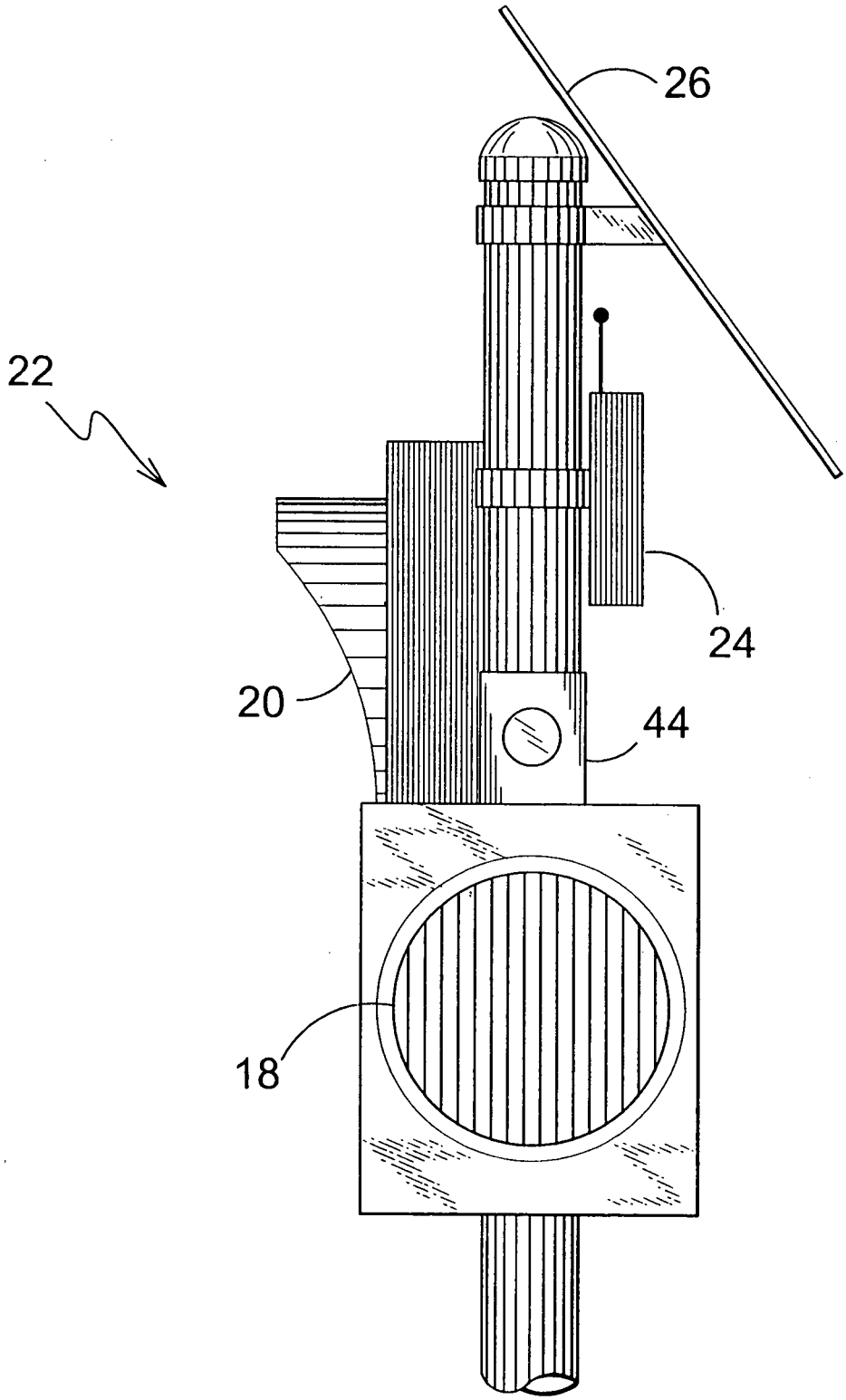
FIG. 10 is a side view of the trail posted crossing indicator having an additional element.

Turning to FIG. 10, shown therein is a side view of the trail posted crossing indicator 22 having an additional element. Shown is the trail posted signaling device 22 having an additional element in the form of a motion detector 44 that will activate the blinking yellow 20 LED display when a trail user moves within a predefined area monitored by the motion detector thereby warning a motorist of the presence of a trail user. Also shown are the red light 18 and the solar panel 26.

I claim:

1. A method for a warning system for use at an intersection of a pedestrian trail and a vehicle roadway, comprising the steps of:

a) providing an emergency vehicle having a first transceiver disposed therein wherein the first transceiver transmits a first signal; and, b) providing a trail crossing indicator having a second transceiver disposed therein wherein the second transceiver receives the first signal and in response thereto activates a pair of warning lights visible to users of both the pedestrian trail and the vehicle roadway, and, transmits a second signal back to the first transceiver thereby acknowledging to the first transceiver and the operator of the emergency vehicle receipt of the first signal by the second transceiver;

c) providing a trail user having a transmitter thereon wherein the transmitter transmits a third signal to the second transceiver; and, d) wherein the second transceiver receives the third signal and in response thereto activates a pair of warning lights visible to users of both the pedestrian trail and the vehicle roadway, and, transmits a fourth signal to the first transceiver thereby indicating to the first transceiver and the operator of the emergency vehicle that a trail user is nearby;

e) providing an on/off control for the first transceiver which is controlled by the operator of the emergency vehicle;

f) providing a visual indication to the operator of the emergency vehicle that the second transceiver disposed in the trail crossing indicator has transmitted the second signal back to the emergency vehicle;

g) providing an audible indication to the operator of the emergency vehicle that the second transceiver disposed in the trail crossing indicator has transmitted the second signal hack to the emergency vehicle;

h) providing an on/off control for the second transceiver which is controlled by the second transceiver;

i) having the trail crossing indicator flesh a yellow warning light to the vehicle roadway and a red warning light to the pedestrian trail;

j) providing a battery power supply to the trail crossing indicator for providing power to the second transceiver and warning lights;

k) providing a solar panel on the trail crossing indicator for providing power to the battery power supply;

l) providing an on/off control for the transmitter which is controlled by the trail user;

m) providing a visual indication to the trail user that the transmitter is transmitting the third signal; and n) mounting a passive detector on the trail crossing indicator that activates the red warning light when an emergency vehicle equipped with a strobe light passive detection system is nearby, thereby warning a trail user that an emergency vehicle is approaching the intersection.

2. The method of claim 1, further comprising the steps of mounting a motion detector on the trail crossing indicator that activates the yellow warning light when a trail user is nearby, thereby warning an operator of the emergency vehicle that a trail user is approaching the intersection.

* * * * *